US008642951B2

(12) United States Patent
Li

(10) Patent No.: US 8,642,951 B2
(45) Date of Patent: Feb. 4, 2014

(54) DEVICE, SYSTEM, AND METHOD FOR REFLECTING IONS

(75) Inventor: Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 461 days.

(21) Appl. No.: 13/101,008

(22) Filed: May 4, 2011

(65) Prior Publication Data

US 2012/0280121 A1 Nov. 8, 2012

(51) Int. Cl.
*H01J 49/40* (2006.01)

(52) U.S. Cl.
CPC ..... *H01J 49/405* (2013.01)
USPC ..... 250/287

(58) Field of Classification Search
CPC ..... H01J 49/405
USPC ..... 250/287
See application file for complete search history.

(56) References Cited

U.S. PATENT DOCUMENTS 5,017,780 A * 5/1991 Kutscher et al. ..... 250/287
5,464,985 A 11/1995 Cornish et al.
5,814,813 A 9/1998 Cotter et al.
5,854,484 A 12/1998 Bergmann
5,955,730 A 9/1999 Kerley et al.
6,024,925 A 2/2000 Little et al.
6,268,131 B1 7/2001 Kang et al.
6,365,892 B1 4/2002 Cotter et al.
6,428,955 B1 8/2002 Koster et al.
6,489,610 B1 12/2002 Barofsky et al.
6,518,569 B1 2/2003 Zhang et al.
6,558,902 B1 5/2003 Hillenkamp
6,569,385 B1 5/2003 Little et al.
6,674,069 B1 1/2004 Martin et al.
6,706,530 B2 3/2004 Hillenkamp
6,717,134 B2 4/2004 Bowdler
6,723,564 B2 4/2004 Hillenkamp
6,777,671 B2 8/2004 Doroshenko
6,818,394 B1 11/2004 O'Donnell-Maloney et al.
6,863,881 B2 3/2005 Greenstein et al.
6,872,574 B2 3/2005 Cravatt et al.
7,071,463 B2 7/2006 Bowdler
7,148,038 B2 12/2006 Mather
7,198,893 B1 4/2007 Koster et al.

(Continued)

FOREIGN PATENT DOCUMENTS

WO WO 2006134380 12/2006
WO 2010092141 A1 8/2010

OTHER PUBLICATIONS

GB1205860.8, Search Report, dated Jul. 23, 2012, 1pg.

(Continued)

*Primary Examiner* — Jack Berman

(57) ABSTRACT

Devices and systems for reflecting ions are provided. In general, the devices and systems include a plurality of curved lens plates adapted for connection to at least one voltage source and having a passage therein to allow the ions to pass therethrough. The plurality of curved lens plates generates electric fields having elliptic equipotential surfaces that reflect and focus the ions as they pass through the passage. Reflectron time-of-flight (RE-TOF) spectrometers are also provided that include an ion source, ion detector, and such a reflectron as described above. Mass spectrometer systems are provided that comprise an ion source that generates ions and a reflectron TOF spectrometer such as described above.

20 Claims, 5 Drawing Sheets

(56) References Cited

U.S. PATENT DOCUMENTS

| | | | | |
|---|---|---|---|---|
| 7,211,792 | B2 | 5/2007 | Yamaguchi et al. | |
| 7,232,688 | B2 | 6/2007 | Little et al. | |
| 7,285,422 | B1 | 10/2007 | Little et al. | |
| 7,390,672 | B2 | 6/2008 | Little et al. | |
| 7,501,251 | B2 | 3/2009 | Koster et al. | |
| 7,527,969 | B2 | 5/2009 | Mather et al. | |
| 7,576,323 | B2 | 8/2009 | Cotter | |
| 7,709,789 | B2 | 5/2010 | Vestal et al. | |
| 7,744,878 | B2 | 6/2010 | Mather | |
| 7,825,374 | B2 | 11/2010 | Cotter et al. | |
| 8,134,119 | B2 * | 3/2012 | Panayi | 250/281 |
| 8,502,139 | B2 * | 8/2013 | Yavor | 250/287 |
| 8,513,597 | B2 * | 8/2013 | Panayi | 250/287 |
| 2004/0021069 | A1 | 2/2004 | Barnard | |
| 2010/0006752 | A1 | 1/2010 | Panayi | |
| 2011/0303841 | A1 | 12/2011 | Yavor | |

OTHER PUBLICATIONS

Cotter, et al., "Tandem Time-of-Flight (TOF/TOF) Mass Spectrometry and Proteomics", J Mass Spectrom Soc Jpn, 2005, 53:7-17.

* cited by examiner

DEVICE, SYSTEM, AND METHOD FOR REFLECTING IONS

BACKGROUND

Mass spectrometers are used to determine the chemical composition of substances and structures of molecules. Mass spectrometers may comprise an ion source to produce ions—e.g., to ionized neutral molecules—as well as a mass analyzer and ion detector. The mass analyzer may be a time-of-flight (TOF) mass analyzer, for example. TOF mass spectrometers may be used to record the mass spectra of compounds or mixtures of compounds by measuring the times for molecular and/or fragment ions of those compounds to travel certain distances. Reflectrons (also known as ion minors) may be implemented in time-of-flight mass spectrometers to reverses the direction of travel of the ions entering the reflectron and to increase mass resolving power and sensitivity. Ions transmitted toward the reflectrons are deflected by the reflectron and received by an ion detector. The ion times of flight may be measured by the ion detector.

SUMMARY

A device, system, and method for reflecting ions are provided herein. In some aspects of the present disclosure, a reflectron for reflecting ions in a time-of-flight mass spectrometer is provided. In general, the reflectron described herein includes a plurality of curved lens plates adapted for connection to at least one voltage source and having a passage therein to allow the ions to pass therethrough. The plurality of curved lens plates generates electric fields having elliptic equipotential surfaces that reflect and focus the ions as they pass through the passage.

Furthermore, in some aspects of the present disclosure, a reflectron time-of-flight (RE-TOF) spectrometer is provided. The RE-TOF spectrometer comprises a transmission electrode for transmitting ions in a first direction; a first reflectron that reflects ions from the transmission electrode; and an ion detector that receives the reflected ions. The first reflectron comprises a first plurality of curved lens plates adapted for connection to a voltage source and having a first passage therein to allow the ions to pass therethrough. The first plurality of curved lens plates generates first electric fields having first elliptic equipotential surfaces that reflect and focus the ions as they pass through the opening. A time of flight spectrometer may contain addition reflectrons.

Still further, in some aspects of the present disclosure, a mass spectrometer system is provided. The mass spectrometer system comprises an ion source that generates ions and a reflectron TOF spectrometer such as described above.

BRIEF DESCRIPTION OF THE FIGURES

The accompanying drawings, which are incorporated herein, form part of the specification. Together with this written description, the drawings further serve to explain the principles of, and to enable a person skilled in the relevant art(s), to make and use the claimed systems and methods.

DETAILED DESCRIPTION

Figure 1B:
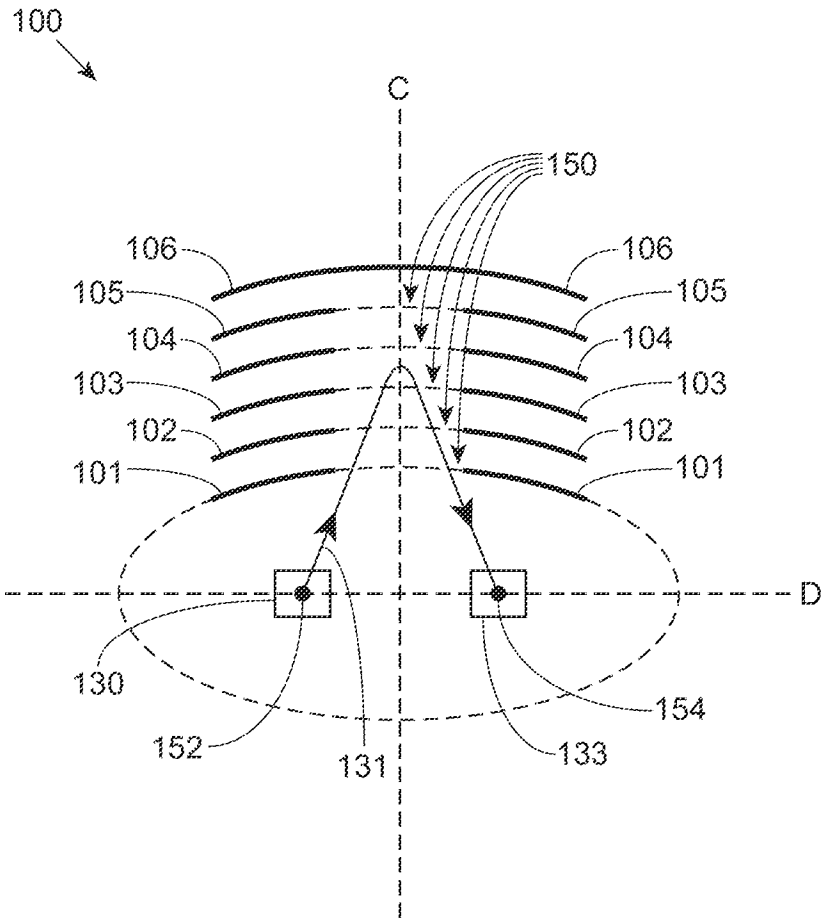
FIG. 1B illustrates a top view of a reflectron comprising the curved lens plate 101 shown in FIG. 1A, according to certain embodiments.

A device, system, and method for reflecting ions are provided herein. In some aspects of the present disclosure, a reflectron for reflecting ions in a time-of-flight mass spectrometer is provided. In general, the reflectron described herein includes a plurality of curved lens plates adapted for connection to at least one voltage source and having a passage therein to allow the ions to pass therethrough. The plurality of curved lens plates generates electric fields having elliptic equipotential surfaces that reflect and focus the ions as they pass through the passage.

In some embodiments, the reflectron comprises at least three curved lens plates. For example, in some instances, a reflectron may include five to one hundred curved lens plates.

In some embodiments, the reflectron comprises a solid electrode plate at a distal end of the plurality of curved lens plates. Passages defined in one or more of the other curved lens plates are defined by openings in the curved lens plates.

In some embodiment, the reflectron comprises mesh disposed across the openings of the one or more curved lens plates at the proximal end of the plurality of curved lens plates, wherein the mesh maintains the elliptic equipotential surfaces across the opening. For example, wire mesh or grid may be disposed across one or more of the passages formed in the curved lens plates to facilitate the elliptical equipotential surface across the passage. The wire mesh or grid may be made from a variety of conductive materials, such as metals, metal-alloys, or other conductive materials. In some embodiments, the materials are partially transparent.

In some embodiment, voltages applied to the plurality of curved lens plates increase in a direction away from the first curved lens plate that the ion passes through. In such case, the first curved lens plate that the ion passes through has a lower voltage applied to it than the second curved lens plate, and so on to the last curved lens plate positioned at a distal end of the plurality of curved lens plates. In some embodiments, the first curved lens plate is electrically coupled to ground or to a potential of the flight tube. It should be appreciated that the voltage increase discussed above may include a negative voltage increase wherein the magnitude of the voltage is increased in a direction away from the first curved leans plate that the ions pass through.

In some embodiments, the elliptic equipotential surfaces are elliptical in the vertical direction and the horizontal direction. In this way, vertically divergent ions and horizontally divergent ions are focused by the reflectron.

In some embodiments, the curved lens plates of the plurality are insulated from one another. For example, each curved lens plate may be separated from one another by an insulator. For example, the plurality of curved lens plates may be interconnected to one or more resistors when coupled to one or more voltage sources. In some instances, one or more potentiometers may be coupled between each curved lens plate and adjusted accordingly. As stated above, one or more voltage sources may be implemented. For example, one voltage source may be implemented across the plurality of plates and resistors. In some instances, multiple voltage sources may be implemented—e.g., one voltage source for each lens plate.

In some embodiments, the passage is defined by square-shaped openings in one or more of the curved lens plates. The passage may be defined by other shaped openings in other embodiments. In some instances, the passage is disposed in the center of the curved lens plate in which it is formed. In some instances, the passage is the same shape as the curved lens plate—e.g., square shaped passage in a square shaped curved lens plate; circular shaped passage in a circular shaped curved lens plate; etc.

In some embodiments, curvatures of each of the curved lens plates are substantially the same as curvatures of the elliptic equipotential surfaces. In some embodiments, the curvatures of each of the curved lens plates are substantially the same as each other. In some embodiments, each of the curved lens plates has a varying degree of curvature.

In some embodiments, the plurality of curved lens plates are equidistantly spaced such that one pair of adjacent curved lens plates is spaced the same distance as another pair of adjacent curved lens plates. In other embodiments, the plurality of curved lens plates is not equidistantly spaced.

In some aspects of the present disclosure, a reflectron time-of-flight (RE-TOF) spectrometer is provided. The RE-TOF spectrometer comprises a transmission electrode that transmits ions in a first direction; a first reflectron that reflects transmitted ions from the transmission electrode; and an ion detector that receives the reflected ions. In some instances, for example, the ions may be pulsed from the transmission electrode. The first reflectron comprises a first plurality of curved lens plates adapted for connection to a voltage source and having a first passage therein to allow the ions to pass therethrough. The first plurality of curved lens plates generates first electric fields having first elliptic equipotential surfaces that reflect and focus the ions as they pass through the opening.

In some embodiments, the RE-TOF spectrometer comprises a second reflectron disposed such that the reflected ions from the first reflectron are again reflected before being received by the ion detector. The second reflectron comprises a second plurality of curved lens plates adapted for connection to the voltage source and having a second passage therein to allow the ions to pass therethrough. The second plurality of curved lens plates generate second electric fields having second elliptic equipotential surfaces that reflect and focus the ions as they pass through the opening.

In some embodiments, the RE-TOF spectrometer comprises one or more additional reflectrons disposed such that the reflected ions from the second reflectron are again reflected one or more additional times before being received by the ion detector. The one or more additional reflectrons comprise additional plurality of curved lens plates adapted for connection to the voltage source and having additional passages therein to allow the ions to pass therethrough. The additional plurality of curved lens plates generates additional electric fields having additional elliptic equipotential surfaces that reflect and focus the ions as they pass through the opening.

In some aspects of the present disclosure, a mass spectrometer system is provided. The mass spectrometer system comprises an ion source that generates ions and a reflectron TOF spectrometer such as described above. Example ion sources may include, but are not limited to, a matrix assisted laser desorption ionization source (MALDI), atmospheric pressure (AP-MALDI), an electrospray ionization (ESI) source, a chemical ionization source (CI) operated in vacuum, a chemical ionization source operated at atmospheric pressure (APCI), and an inductively coupled plasma (ICP) source.

In some embodiments, the mass spectrometer system comprises a mass analyzer between the ion source and the reflectron TOF spectrometer. In some embodiments, the mass analyzer comprises a mass filter or a collision cell. For example, in some instances, the mass analyzer is a quadrupole mass analyzer, such as used with a quadrupole time-of-flight mass spectrometry (QTOF). In some embodiments, a chromatography system is coupled to the ion source. For example, the chromatography system may serve to separate compounds chromatographically before they are introduced to the ion source and mass spectrometer.

The following detailed description of the figures refers to the accompanying drawings that illustrate exemplary embodiments. Other embodiments are possible. Modifications may be made to the embodiments described herein without departing from the spirit and scope of the present invention. Therefore, the following detailed description is not meant to be limiting.

Figure 1A:
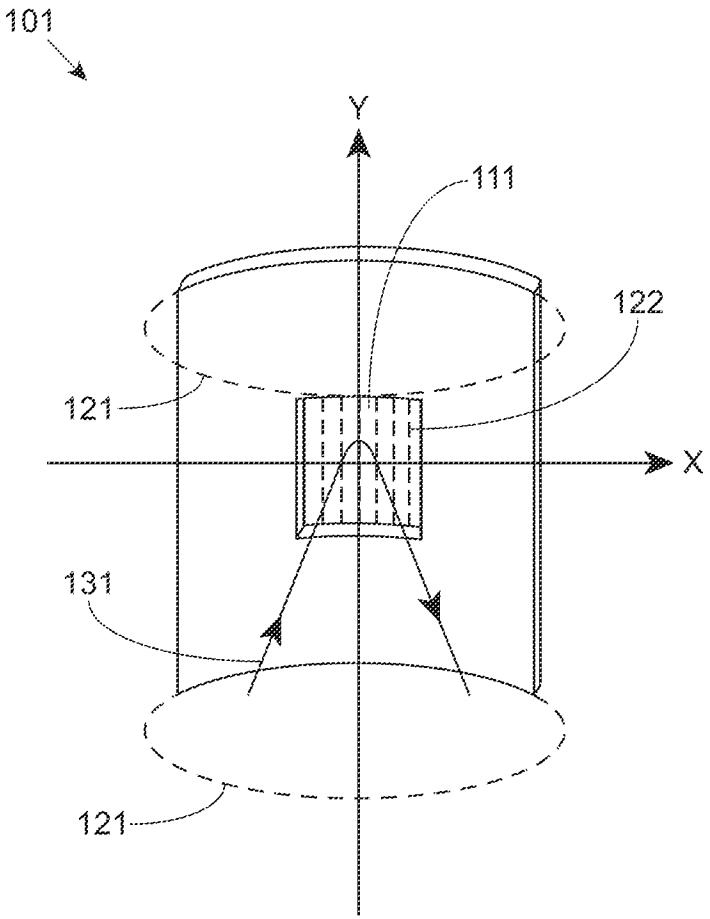
FIG. 1A illustrates a front perspective view of a curved lens plate, according to certain embodiments.

FIG. 1A illustrates a front perspective view of a curved lens plate, according to certain embodiments. Curved lens plate 101 is shown comprising a passage 111 within the curved lens plate 101. Ions generated by an ion source 130 are transmitted by a transmission electrode towards the curved lens plate 101 and through the passage 111. In the embodiment shown, the passage is square-shaped and located in the center of the curved lens plate 101. It should be appreciated that the shape and location of the passage may vary in other embodiments. Horizontal axis X and vertical axis Y are illustrated for reference purposes.

Curved lens plate 101 is elliptically shaped in the horizontal direction. Reference ellipses 121 are shown in dotted lines for reference purposes, and illustrate that the curvature of the curved lens plate 101 in the horizontal direction is elliptically shaped. When curved lens plate 101 is connected to a voltage source (not shown) and maintained at an electric potential, an elliptic equipotential surface is generated. The elliptic equipotential surface is provided across the passage. For example, the curvature of the elliptic equipotential surface may be substantially the same as the curvature of the curved lens plate. Ions that enter passage 111 are subjected to the elliptic equipotential generated by the curved lens plate 101. As will be shown later, additional curved lens plates are also implemented in the reflectron and the ions are eventually deflected back out of passage 111, as shown by ion flight path 131.

In some embodiments, such as shown in FIG. 1A, curved lens plate 101 includes a wire mesh or grid 122 that is disposed across passage 111. Mesh 122 serves to maintain the elliptical equipotential surface across the passage 111.

It should be appreciated that in other embodiments, the curved lens plate may be elliptically shaped in the vertical direction as well as the horizontal direction. In this way, elliptic equipotential surfaces are elliptical in the horizontal and vertical direction.

FIG. 1B illustrates a top view of a reflectron comprising the curved lens plate 101 shown in FIG. 1A, according to certain embodiments. Reflectron 100 is shown including a plurality of curved lens plates—curved lens plate 101 (e.g., as shown in FIG. 1A), curved lens plate 102, curved lens plate 103, curved lens plate 104, curved lens plate 105, and curved lens plate 106. Curved lens plates 102,103,104,105 each include a passage created by an opening in the curved lens plate—e.g., as described in FIG. 1A for curved lens plate 101. Curved lens plate 101 is also referred to herein as the front electrode 101 since ions enter the reflectron 100 through curved lens plate 101, as shown by ion flight path 131. Curved lens plate 106 is also referred to herein as the back electrode 106, since it is the distal most electrode in the reflectron 100. In some embodiments, such as shown in FIG. 1B, the back electrode at the distal end of the plurality of curved lens plates is solid and does not include a passage formed by an opening. Since ions do not pass through curved lens plate 106, a passage is not required in curved lens plate 106.

In the embodiment shown, each of the curved lens plates has approximately the same degree of curvature. It should be appreciated that in other embodiments, some or all of the curved lens plates may have a varying degree of curvature. For example, in some instances, the back electrode 106 may be less curved than the other electrode. In some instances, the back electrode 106 may not be curved.

It should be appreciated that the distance between the curved lens plates may vary in different embodiments. For example, in some embodiments, the plurality of curved lens plates are equidistantly spaced such that one pair of adjacent curved lens plates is spaced the same distance as another pair of adjacent curved lens plates. In other embodiments, the plurality of curved lens plates is not equidistantly spaced.

In some embodiments, adjacent curved lens plates are separated by insulators. For example, the plurality of curved lens plates may be interconnected to one or more resistors when coupled to one or more voltage sources. In some instances, one or more potentiometers may be coupled between each curved lens plate and adjusted accordingly.

In FIG. 1B, the plurality of curved lens plates 101,102,103, 104,105,106 are connected to one or more voltage sources (not shown) and maintained at electric potentials. Elliptic equipotential surfaces 150 are generated across the passages within curved lens plates 101,102,103,104,105, as represented by dotted lines in FIG. 1B.

In some embodiments, the voltage applied to each of the plurality of curved lens plates may vary. For example, in some embodiments, voltages applied to the plurality of curved lens plates increase in a direction away from the first curved lens plate that the ion passes through. In such case, the first curved lens plate that the ion passes through has a lower voltage applied to it than the second curved lens plate, and the second lens plate having a lower voltage than the third curved lens plate, and so on. In such case, the last curved lens plate positioned at a distal end of the plurality of curved lens plates has the largest voltage applied to it. In some embodiments, the first curved lens plate is electrically coupled to ground or to a potential of the flight tube. As stated above, it should be appreciated that the voltage increase discussed above may include a negative voltage increase wherein the magnitude of the voltage is increased in a direction away from the first curved leans plate that the ions pass through.

In use, an ion source 130 generates ions for transmission by a transmission electrode in a first direction towards the reflectron 100. The ion source 130 may provide, for example, a packet of ions at the same kinetic energies for transmission towards reflectron 100. The ions are transmitted along flight path 131 and enter reflectron 100 through passage 111. As the ions travel further into the reflectron, the ions are decelerated and eventually accelerated back out of the reflectron 100 by elliptic equipotential surfaces 150. Depending on how far the ions travel into the reflectron 100, the ions may pass through one or more of the other passages within curved lens plates 102,103,104,105.

Since the ions enter the reflectron 100 (e.g., incident path) at an angle to the center axis C of the reflectron, the ions are deflected back out of the reflectron (e.g., deflection path) at an angle to the center axis C. The reflectron 100 has two focal points 152,154 in which the elliptic equipotential surfaces correspond to. The ion source 130 is positioned at one of the focal points 152 of the reflectron 100, and the ions are deflected back out of the reflectron 100 to the other focal point 154.

The focal points 152,154 are at equivalent distances to the reflectron (as illustrated by dotted line D) and symmetrical with respect to center axis C. Thus, the ion detector 133 may be positioned at the other focal point 154 to detect the reflected ions.

As noted above, the reflectron produces electric fields having elliptic equipotential surfaces. The term "elliptic equipotential surface" is used herein to mean an elliptically shaped surface of constant scalar potential. The elliptic equipotential surfaces are perpendicular to the net electric field lines passing through it. An elliptically-shaped surface provides two focal points whereas a circular shaped surface provides only one focal point. Circularly-shaped equipotential surfaces and surfaces having curvatures that do not provide two focal points are not encompassed by this definition.

Since measurements using TOFMS depend on time, the distance the ions travel may affect the time measurements. Thus, ions transmitted from the ion source at divergent angles will have different distances traveled. The properties of ellipses are such that the distance from each focal point to any given point on the ellipse is always the same. Thus, the sum total distance from each focal point to any point on an elliptic equipotential will always be the same despite the initial divergent angle. Therefore, ions of the same mass and energy level but with diverging angle from one another will travel the same distance despite being reflected at different points along the same elliptic equipotential surface. In this way, spatial focusing is achieved and no time error results.

Furthermore, ions having different mass/charge ratios (e.g. m/z ratios) have slightly different kinetic energies and thus travel through the TOF tube at different speeds. Reflectrons of the present disclosure improve the spatial focusing, as well as the time focusing of ions at the ion detector, improving mass resolution. The reflectrons compensate for the initial kinetic energy differences of ions, independent of the mass of the ions.

The reflectron is used to "focus" the ions at the same point within the system, with ions of different mass/charge arriving at that point at different times. As the ions enter the reflectron, ions with higher kinetic energy (velocity) penetrate the reflectron deeper than those with lower kinetic energy, and thus travel a longer path to their focal point. Ions of lower energy reverse flight direction at different equipotential surface than ions of higher energy. Ions of higher energy travel further within the reflectron and reverse flight direction at an equipotential surface further within the reflectron. Ions with different kinetic energies reach the focal point (e.g., ion detector) at essentially the same time.

Figure 2:
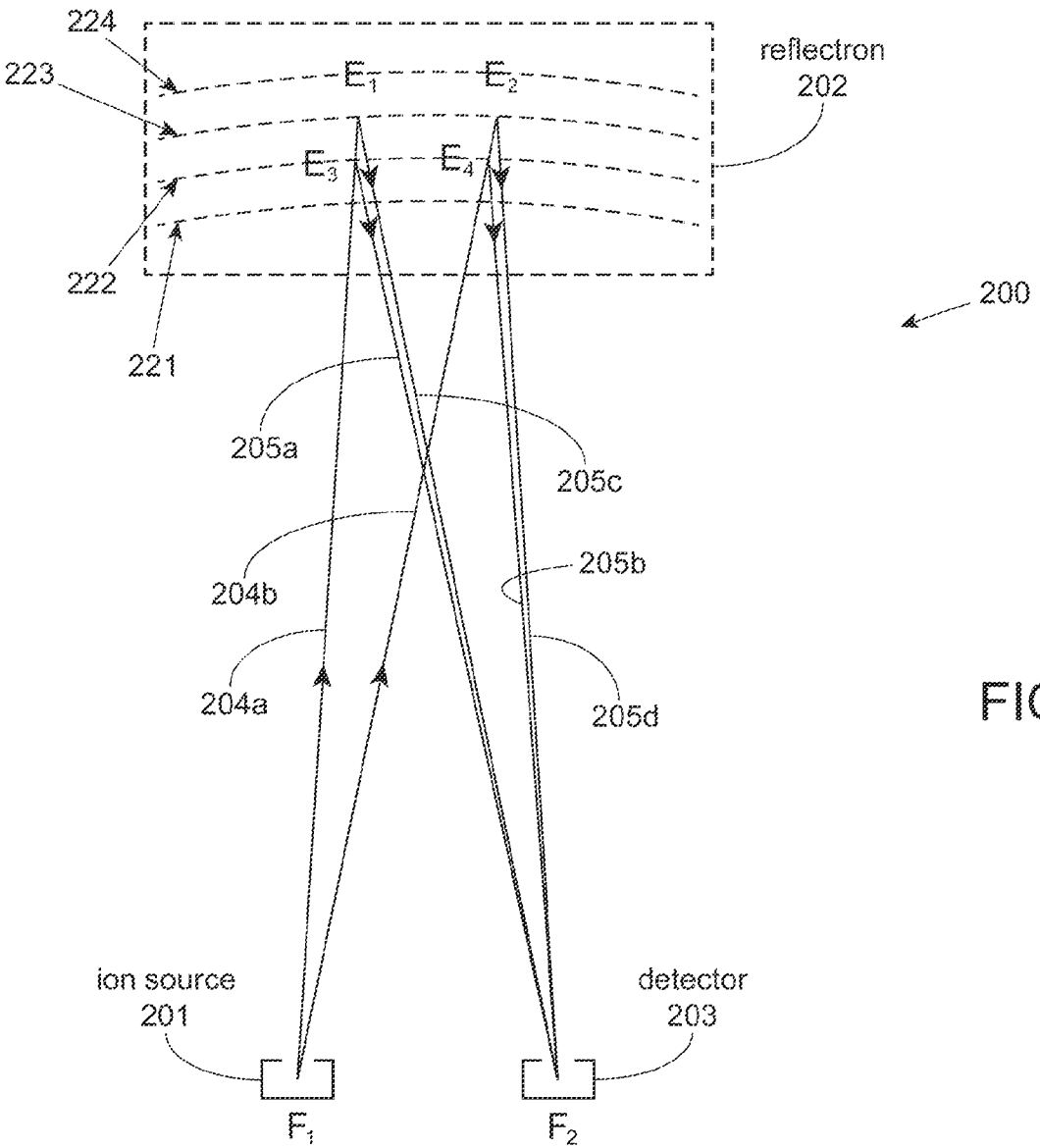
FIG. 2 illustrates a diagram of a reflectron time-of-flight mass spectrometer, according to the certain embodiments.

FIG. 2 illustrates a reflectron TOFMS, according to the certain embodiments. Reflectron TOFMS 200 includes a transmission electrode 201, reflectron 202, and ion detector 203. Transmission electrode 201 is positioned at one focal point F1 of the reflectron 202 and provides ions that are transmitted toward the reflectron 202. Example ion sources may include, but are not limited to, a matrix assisted laser desorption ionization source (MALDI), atmospheric pressure (AP-MALDI), an electrospray ionization (ESI) source, a chemical ionization source (CI) operated in vacuum, a chemical ionization source operated at atmospheric pressure (APCI), and an inductively coupled plasma (ICP) source.

Not all ions follow the same path, as represented by divergent incident ion paths 204*a*, 204*b*. Reflectron 202 comprises elliptic equipotential surfaces 221,222,223,224 that are generated by a plurality of curved lens plates, such as those described above, which are electrically coupled to one or more voltage sources (not shown). The elliptic equipotential surfaces 221,222,223,224 generated by reflectron 202 cause the ions to reflect back out of the reflectron 202 towards ion detector 203 positioned at focal point F2, as represented with reflected beams 205*a*, 205*b*, 205*c*, 205*d*.

As stated above, the properties of ellipses are such that the distance from each focal point to any given point on the ellipse is always the same. Thus, the sum total distance from each focal point to any point on an elliptic equipotential will always be the same despite the initial divergent angle. Therefore, ions of the same mass and energy level but with diverging angle from one another will travel the same distance despite being reflected at different points along the same elliptic equipotential surface. In this way, no time error results. Furthermore, ions of different kinetic energies are focused such that ions of different kinetic energy reverse flight direction at different equipotential surfaces and arrive at the ion detector at the same time.

As shown, ions of lower energy following incident beams 204*a*,204*b* are reflected at equipotential surface 222 along reflected paths 205*a*,205*b*, respectively, and focused at ion detector 203. Ions of higher energy following incident beams 204*a*,204*b* are reflected at equipotential surface 223 (which is further within the reflectron 202 than equipotential surface 222) along reflected paths 205*c*,205*d*, respectively, and focused at ion detector 203. Therefore, ions of different divergent angles and energy spread are always reflected and focused at the detector, and spatial and time focus are both achieved.

Because ions are reflected more than once and travel a much larger distance in a multi-reflectron TOFMS, beam divergence, and loss in ion transmission, may be more significant if not accounted for. In some aspects of the present disclosure, multi-reflectron TOFMS including more than one of the reflectron TOFMS described above are provided. The characteristics and properties of the reflectrons of the present disclosure account for such problems and avoid them.

Figure 3:
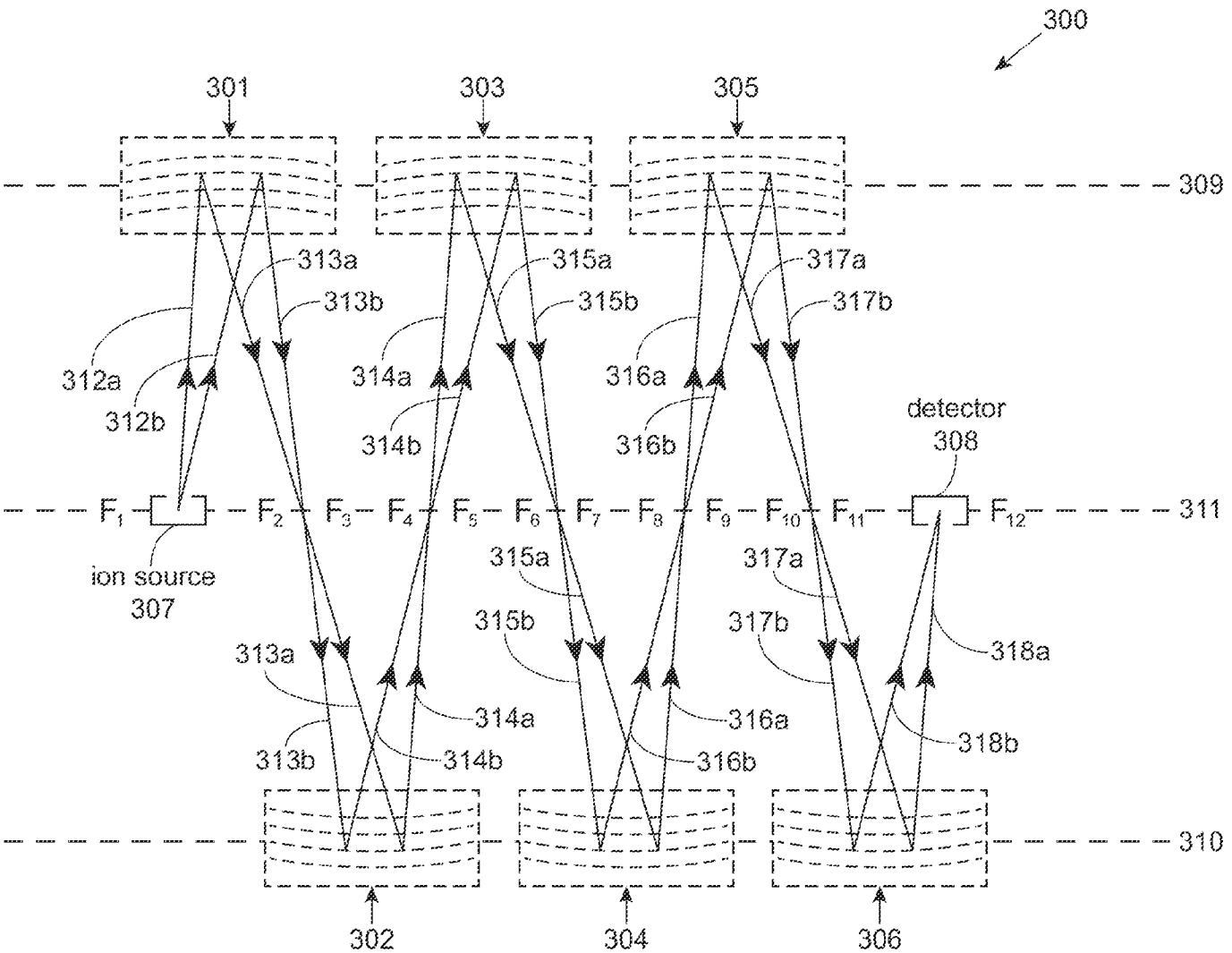
FIG. 3 illustrates a diagram of a multi-reflectron time-of-flight mass spectrometer, according to certain embodiments.

FIG. 3 illustrates a multi-reflectron TOFMS, according to certain embodiments. Multi-reflectron TOFMS 300 is shown comprising reflectrons 301,302,303,304,305,306 (e.g., reflectrons described above); a transmission electrode 307; and an ion detector 308. Reflectrons 301,302,303,304,305, 306 are configured in two parallel rows 309,310. Reflectrons 301,303,305 are in row 309 and reflectrons 302,304,306 are in row 310.

Reflectrons 301,303,305 face towards reflectrons 302,304, 306, and vice versa. Reflectron 301 has two focus points F1,F2; reflectron 302 has two focus points F3,F4; reflectron 303 has two focus points F5,F6; reflectron 304 has two focus points F7,F8; reflectron 305 has two focus points F9,F10; and reflectron 306 has two focus points F11,F12.

Transmission electrode 307 is disposed at one focus point F1 of reflectron 301. Reflectron 302 is positioned such that focus point F2 and focus point F3 coincide. Reflectron 303 is positioned such that focus point F4 and focus point F5 coincide. Reflectron 304 is positioned such that focus point F6 and focus point F7 coincide. Reflectron 305 is positioned such that focus point F8 and focus point F9 coincide. Reflectron 306 is positioned such that focus point F10 and focus point F11 coincide. Ion detector 308 is positioned at focus point F12.

Because reflectrons 301,302,303,304,305,306 generate electric fields having elliptic equipotential surfaces, the focus points of reflectrons 301,302,303,304,305,306 align in a row 311 that is parallel to, and which bisects, rows 309,310.

In use, transmission electrode 307 transmits ions generated by an ion source towards reflectron 301. The ions transmitted towards reflectron 301 are deflected to reflectron 302. The reflected ions are then reflected by reflectron 302 to reflectron 303. The reflected ions are then reflected by reflectron 303 to reflectron 304. The reflected ions are then reflected by reflectron 304 to reflectron 305. The reflected ions are then reflected by reflectron 305 to reflectron 306. The reflected ions are then reflected by reflectron 306 to ion detector 308.

The ion beams transmitted by transmission electrode 307 are laterally and energy focused. Ions transmitted from transmission electrode 307 to reflectron 301 with different divergent angles and energy spread are reflected and focused at focus point F2. As show, incident ion beams 312*a*,312*b* are reflected as reflected beams 313*a*,313*b*, respectively, which coincide at focus point F2. Reflected ion beams 313*a*,313*b* are then reflected by reflectron 302 as reflected ion beams 314*a*,314*b*, respectively, which coincide at focus point F4. Reflected ion beams 314*a*,314*b* are then reflected by reflectron 303 as reflected ion beams 315*a*,315*b*, respectively, which coincide at focus point F6. Reflected ion beams 315*a*, 315*b* are then reflected by reflectron 304 as reflected ion beams 316*a*,316*b*, respectively, which coincide at focus point F8. Reflected ion beams 316*a*,316*b* are then reflected by reflectron 305 as reflected ion beams 317*a*,317*b*, respectively, which coincide at focus point F10. Reflected ion beams 317*a*, 317*b* are then reflected by reflectron 306 as reflected ion beams 318*a*,318*b*, respectively, which coincide at focus point F12 and ion detector 308. The ion beams 318*a*,318*b* provided at the ion detector 308 are spatial and time focused. There is essentially no transmission loss in the system; and further, high mass resolving power and high sensitivity are achieved.

Figure 4:
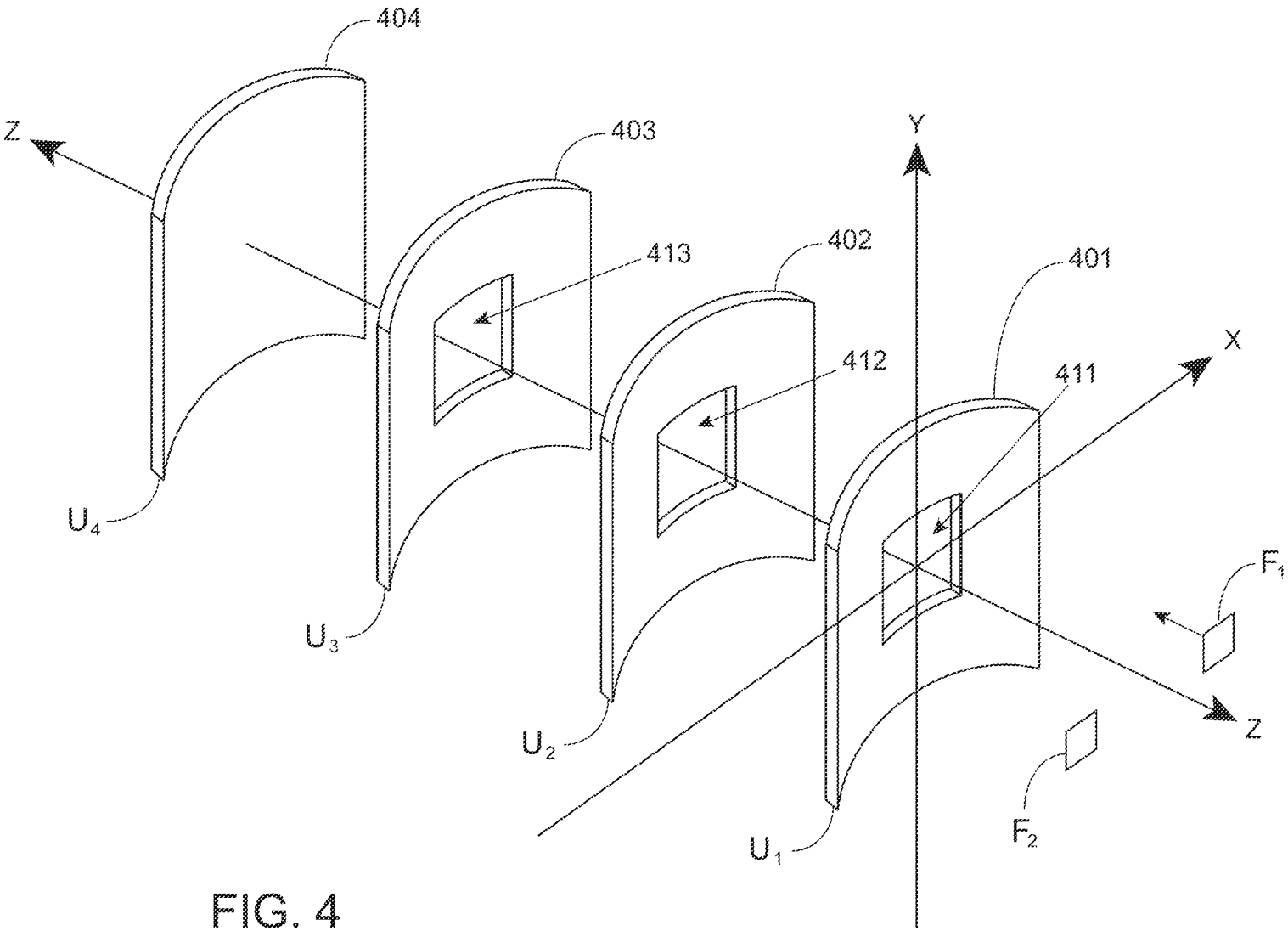
FIG. 4 illustrates an exploded perspective view of a plurality of curved lens plates of a reflectron, according to certain embodiments.

FIG. 4 illustrates an exploded perspective view of a plurality of curved lens plates of a reflectron, according to certain embodiments. In the embodiment shown, a plurality of curved lens plates comprises curved lens plate 401, curved lens plate 402, curved lens plate 403, and curved lens plate 404. Each of the curved lens plates 401,402,403,404 are elliptically in the horizontal direction. Curved lens plate 401 is the front electrode in which the ions enter the reflectron, and curved lens plate 404 is the back electrode. Curved lens plates 401,402,403 are shown including passages 411,412,413 that are formed by opening in the curved lens plates in which ions travel through. In some embodiments, mesh is disposed across the passages, as described above. The back electrode at the distal end of the plurality of curved lens plates is solid and does not include a passage formed by an opening. Since ions do not pass through curved lens plate 404, a passage is not required in curved lens plate 404. Opening 411 may contain a vertical grid (not shown).

It should be appreciated some elements may not be shown in the figures. For example, additional elements such as mounting rods and spacers may be implemented to align and position the plurality of curved lens plates.

Curved lens plate 401 is electrically coupled to a voltage source and maintained at potential U1; curved lens plate 402 is electrically coupled to a voltage source and maintained at potential U2; curved lens plate 403 is electrically coupled to a voltage source and maintained at potential U3; and curved lens plate 402 is electrically coupled to a voltage source and maintained at potential U4. The elliptical shaped curved lens plates are maintained at electric potentials and generate elliptical equipotential surfaces. It should be appreciated that one or more voltage sources may be configured to provide the various electric potentials. For example, in some instances, resistors may be coupled between the curved lens plates, with the distal or back curved lens plate coupled to a voltage source and the initial or front curved lens plate (and/or entrance grid or mesh) coupled to ground or a potential of the flight tube.

In certain embodiments, the curved lens plate 401 is electrically coupled to ground. In some instances, the curved lens plate 401 is electrically coupled to the potential of the flight tube.

Furthermore, as similarly described above, in certain embodiments, the electric potentials increase in a direction away from the first curved lens plate that the ion passes through. For example, in some embodiments, the electric potentials for the plurality of curved lens plates increase from curved lens plate 401 to the curved lens plate 404.

In use, an ion source provides ions for transmission by a transmission electrode toward the reflectron 400. For example, as shown, ions are provided by ion source F1 and transmitted towards the plurality of curved lens plates. The ions enter the reflectron through passage 411. Depending on how far the ions travel into the reflectron before being completely deflected out of the reflectron, the ions may pass through one or more of the other passages 412,413.

As ions enter the plurality of curved lens plates, the ions encounter the elliptic equipotential surfaces generated by electrode plates 401,402,403,404. The ions are decelerated and then accelerated back out of the passages in which it entered. The ion source is disposed at one of the focus points of the reflectron (e.g., at the focus point of the elliptic equipotential surfaces generated by the reflectron) and the ions are deflected back out the reflectron to the other focus point of the reflectron (e.g., the other focus point of the elliptic equipotential surfaces generated by the reflection). The ions are laterally and energy focused at the ion detector F2.

Figure 5:
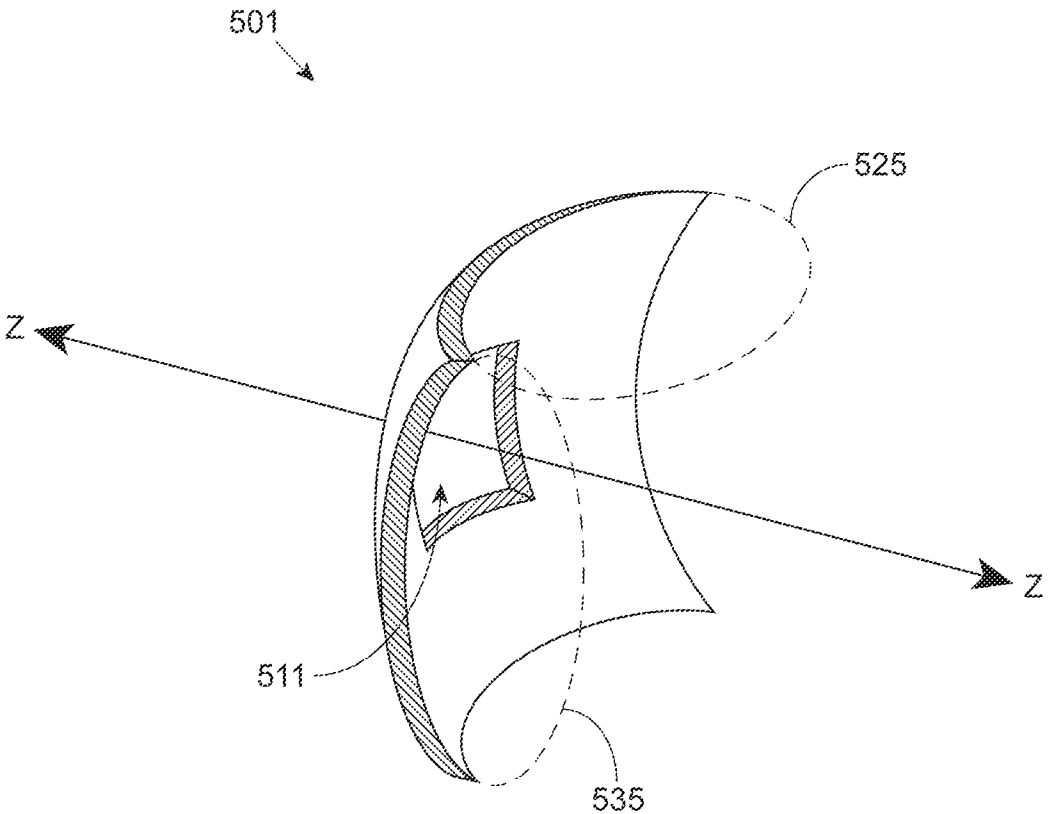
FIG. 5 illustrates a perspective view of a curved lens plate that is elliptically shaped in both the horizontal and vertical dimensions, according to certain embodiments.

In some embodiments, the curved lens plates of the reflectron are elliptically shaped in both the horizontal and vertical dimensions. FIG. 5 illustrates a curved lens plate that is elliptically shaped in both the horizontal and vertical dimensions, according to certain embodiments. For the sake of brevity and clarity, only one curved lens plate is illustrated and described in FIG. 5. It should be appreciated that one or more other curved lens plates similar to the one shown in FIG. 5 may be implemented in a reflectron according to the present disclosure. Curved lens plate 501 is shown comprising passage 511 formed by an opening within curved lens plate 501. Curved lens plate 501 is generally square shaped but curved in the horizontal and vertical direction. The curved lens plate 501 is maintained at an electric potential by a voltage source (not shown) and generates a resulting elliptic equipotential surface.

Reference ellipse 525 is shown as a dotted line and represents an ellipse in the horizontal direction. Similarly, reference ellipse 535 is shown as a dotted lien and represents an ellipse in the vertical direction. As shown in FIG. 5, the curved lens plate 501 is elliptically shaped in the horizontal and vertical direction, and generates an elliptic equipotential surface that is elliptic in the horizontal and vertical directions.

In some aspects of the present disclosure, a method of reflecting ions is provides. The method comprises receiving a transmitted ion at a plurality of curved lens plates in a reflectron, and reflecting the ions back out of the electron. The plurality of curved lens plates are adapted for connection to at least one voltage source and have a passage therein to allow the ions to pass therethrough. The plurality of curved lens plates generate electric fields having elliptic equipotential surfaces that reflect and focus the ions as they pass through the passage.

In some embodiments, the reflected ion is received by an ion detector. In other embodiments, the method comprises receiving the reflected ion at a second plurality of curved lens plates in a second reflectron before the reflected ion is received by an ion detector. In some embodiments, the ion is reflected by multiple reflectrons—e.g., two or more electrons, including three to one hundred reflectrons.

In some embodiments, the ion is generated by an ion source and provided to a transmission electrode for transmission to the reflectron. In some instances, the ion is received by a mass analyzer before being transmitted to the reflectron.

The foregoing description of the invention has been presented for purposes of illustration and description. It is not intended to be exhaustive or to limit the invention to the precise form disclosed. Other modifications and variations may be possible in light of the above teachings. The embodiments were chosen and described in order to best explain the principles of the invention and its practical application, and to thereby enable others skilled in the art to best utilize the invention in various embodiments and various modifications as are suited to the particular use contemplated. It is intended that the appended claims be construed to include other alternative embodiments of the invention; including equivalent structures, components, methods, and means.

Unless defined otherwise, all technical and scientific terms used herein have the same meaning as commonly understood by one of ordinary skill in the art to which this invention belongs.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. All combinations of the embodiments are specifically embraced by the present invention and are disclosed herein just as if each and every combination was individually and explicitly disclosed, to the extent that such combinations embrace operable processes and/or devices/systems/kits.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

It is to be appreciated that the Detailed Description section, and not the Summary and Abstract sections, is intended to be used to interpret the claims. The Summary and Abstract sections may set forth one or more, but not all exemplary embodiments of the present invention as contemplated by the inventor(s), and thus, are not intended to limit the present invention and the appended claims in any way.

What is claimed is:

1. A reflectron for reflecting ions in a time-of-flight mass spectrometer, comprising:

a plurality of curved lens plates adapted for connection to at least one voltage source and having a passage therein to allow the ions to pass therethrough;

wherein the plurality of curved lens plates generate electric fields having elliptic equipotential surfaces that reflect and focus the ions as they pass through the passage.

2. The reflectron of claim 1, comprising at least three curved lens plates.

3. The reflectron of claim 1, comprising five to one hundred curved lens plates.

4. The reflectron of claim 1, comprising a solid electrode plate at a distal end of the plurality of curved lens plates, wherein the passage is defined by openings in the curved lens plates.

5. The reflectron of claim 4, comprising mesh disposed across the openings of the one or more curved lens plates at the proximal end of the plurality of curved lens plates, wherein the mesh maintains the elliptic equipotential surfaces across the opening.

6. The reflectron of claim 1, wherein voltages applied to the plurality of curved lens plates increases in a direction away from the first curved lens plate that the ion passes through.

7. The reflectron of claim 1, wherein the elliptic equipotential surfaces are elliptical in both the vertical direction and the horizontal direction.

8. The reflectron of claim 1, wherein the curved lens plate of the plurality are insulated from one another.

9. The reflectron of claim 1, wherein the passage is defined by square-shaped openings in one or more of the curved lens plates.

10. The reflectron of claim 1, wherein curvatures of each of the curved lens plates are substantially the same as curvatures of the elliptic equipotential surfaces.

11. The reflectron of claim 1, wherein curvatures of each of the curved lens plates are substantially the same.

12. The reflectron of claim 1, wherein each of the curved lens plates has a varying degree of curvature.

13. A reflectron time-of-flight (TOF) spectrometer, comprising:

a transmission electrode that transmits ions in a first direction;

a first reflectron that reflects ions transmitted from the transmission electrode, the first reflectron comprising:

a first plurality of curved lens plates adapted for connection to a voltage source and having a first passage therein to allow the ions to pass therethrough;

wherein the first plurality of curved lens plates generate first electric fields having first elliptic equipotential surfaces that reflect and focus the ions as they pass through the opening; and an ion detector that receives the reflected ions.

14. The reflectron TOF spectrometer of claim 13, comprising:

a second reflectron disposed such that the reflected ions from the first reflectron are again reflected before being received by the ion detector, the second reflectron comprising:

a second plurality of curved lens plates adapted for connection to the voltage source and having a second passage therein to allow the ions to pass therethrough;

wherein the second plurality of curved lens plates generate second electric fields having second elliptic equipotential surfaces that reflect and focus the ions as they pass through the opening.

15. The reflectron TOF spectrometer of claim 14, comprising:

one or more additional reflectrons disposed such that the reflected ions from the second reflectron are again reflected one or more additional times before being received by the ion detector, the one or more additional reflectrons comprising:

additional plurality of curved lens plates adapted for connection to the voltage source and having additional passages therein to allow the ions to pass therethrough;

wherein the additional plurality of curved lens plates generate additional electric fields having additional elliptic equipotential surfaces that reflect and focus the ions as they pass through the opening.

16. A mass spectrometer system, comprising an ion source that generates ions; and a reflectron TOF spectrometer according to claim 13.

17. The mass spectrometer system of claim 16, wherein the ion source is selected from a group consisting of: a matrix assisted laser desorption ionization source (MALDI), atmospheric pressure (AP-MALDI), an electrospray ionization (ESI) source, a chemical ionization source (CI) operated in vacuum, a chemical ionization source operated at atmospheric pressure (APCI), and an inductively coupled plasma (ICP) source.

18. The mass spectrometer system of claim 16, comprising a mass analyzer between the ion source and the reflectron TOF spectrometer.

19. The mass spectrometer system of claim 18, wherein the mass analyzer comprises a mass filter or collision cell.

20. The mass spectrometer system of claim 16, comprising a chromatography system coupled to the ion source.

* * * * *